US010208545B2

(12) United States Patent
Newman et al.

(10) Patent No.: US 10,208,545 B2
(45) Date of Patent: Feb. 19, 2019

(54) BLADE STABILISER TOOL FOR DRILL STRING

(71) Applicant: European Drilling Projects B.V., Heerhugowaard (NL)

(72) Inventors: Michael Thomas Newman, Tuitjenhorn (NL); Ricardo Kok, Heerhugowaard (NL)

(73) Assignee: European Drilling Projects B.V., Heerhugowaard (NL)

( * ) Notice: Subject to any disclaimer, the term of this patent is extended or adjusted under 35 U.S.C. 154(b) by 256 days.

(21) Appl. No.: 15/067,585

(22) Filed: Mar. 11, 2016

(65) Prior Publication Data

US 2016/0265287 A1 Sep. 15, 2016

(30) Foreign Application Priority Data

Mar. 13, 2015 (EP) ..... 15159006

(51) Int. Cl.
*E21B 17/10* (2006.01)

(52) U.S. Cl.
CPC ..... *E21B 17/1078* (2013.01)

(58) Field of Classification Search
CPC .. E21B 17/1078; E21B 17/10; E21B 17/1085; E21B 17/16
See application file for complete search history.

(56) References Cited

U.S. PATENT DOCUMENTS 4,280,742 A * 7/1981 Justman ..... E21B 17/1078 175/325.4
4,301,876 A * 11/1981 Harrison ..... E21B 7/28 175/325.2
4,378,852 A * 4/1983 Garrett ..... E21B 10/62 166/173
4,508,184 A * 4/1985 Hansen ..... E21B 10/30 175/346
6,776,247 B1 * 8/2004 Bassal ..... E21B 17/1078 166/241.2
8,434,570 B2 * 5/2013 Boulet ..... E21B 7/04 175/320
2006/0207796 A1 * 9/2006 Stewart ..... E21B 10/26 175/57

FOREIGN PATENT DOCUMENTS

EP 1650400 A1 * 4/2006 ..... E21B 17/10

* cited by examiner

*Primary Examiner* — Taras P Bemko
*Assistant Examiner* — Jonathan Malikasim
(74) *Attorney, Agent, or Firm* — Rankin, Hill & Clark LLP

(57) ABSTRACT

A drilling string stabilizer tool comprises a cylindrical body and a plurality of stabilizer blades mounted on the outer surface of the cylindrical body. The stabilizer blades have an elongated shape and a monolithic structure with an upper stabilizing part and a lower mounting part. Between each two adjacent blades there can optionally be a hydrodynamic flute for improving the flow of liquid and cuttings during drilling and tripping.

17 Claims, 7 Drawing Sheets

(STATE OF THE ART)

BLADE STABILISER TOOL FOR DRILL STRING

CROSS REFERENCE TO RELATED APPLICATIONS

This application claims priority to EP patent application No. 15159006.4, filed Mar. 13, 2015, which is incorporated herein by reference thereto.

FIELD OF THE INVENTION

The present invention relates to a blade stabiliser tool used for stabilizing the operation of a drill string when drilling oil, gas, or geothermal wells.

STATE OF THE ART

In directional drilling it is very important to maintain full control of the operations. To maintain control of the drill string, it is known to use a certain number, normally 2 or 3, of so called drilling stabilisers placed in the bottom hole assembly. An example of a drilling string with a bottom hole assembly configuration with 2 stabilisers is shown in FIG. 1. The primary function of the stabilisers in the drilling string is to support and stabilise the bottom hole assembly in the borehole through the earth surface. The design of the stabiliser blades should be such that they reduce both friction and drag in the borehole during all phases of the drilling operations, thus preventing the well-known problems such as damage to the borehole, balling up and borehole instability. In addition the stabiliser should not inhibit the drilled cuttings being carried out of the hole by the drilling fluid. The contact area of the stabiliser blades should be large enough to adequately support the drill string in the borehole while minimising or eliminating penetration of the borehole wall. The stabiliser should also provide stability when weight is applied or buffeting occurs caused by vibration and shock loads being transmitted through the drill string. A drilling string stabiliser tool comprises a cylindrical stabiliser body and a plurality of stabiliser blade assemblies made of high-strength steel located on the outer surface of said cylindrical body. The blades can be either straight or spiraled with hard surface for wear resistance. The blades can be machined as an integral part of the cylindrical body or can be machined onto a sleeve screwed to the body thus making the sleeve replaceable. Blades can be directly welded to the cylindrical body (welded blade stabilisers).

EP1650400 describes a stabiliser blade assembly with a stabiliser blade 1, shown in FIG. 2, having an upper stabilizing part 2 and a lower mounting part 3. The stabilizing part 2 has an elongated shape with front end 4 and a back end 5, an upper surface 6 and substantially upright side walls 7. The average width of the back half of the stabilizing part 2 is tapered towards the back end 5 and thereby the average width of the back half portion substantially smaller than the average width of the front half portion. The upper and bottom surface of the stabiliser blade slope near and towards the front end 4. The shape of the stabiliser blades 1 and their positioning are such that they can efficiently displace the drilling fluids and drilling cuttings around the blades, and greatly reduce balling-up and packing off of the stabiliser with drilled cuttings. The tapered shapes of the blade reduce friction, and enhance the stabilisers performance while sliding in the oriented mode. The function of the cross sectional taper of the blade is to reduce rotary torque and minimize undercutting when drilling in the rotary mode. The stabiliser blade assembly comprises tapered mounting blocks, having holes for mounting the blocks on the stabiliser body with bolts. The stabiliser blade comprises a downwards projecting mounting part 3 having tapered front 9 and back 10 walls. The cylindrical surface of central portion of the stabiliser body is provided with axially aligned mounting slots having the same width and height as the mounting part 3 of the stabiliser blades 1. The stabiliser blades are mounted in the recess, milled in the body of the stabiliser and secured to the body by the two tapered mounting blocks both mounted in the recess, one in front of the blade and one after. The tapered part of the blocks mates with the tapered walls 9 and 10 of the mounting part 3 of the stabiliser blade. Each of the tapered mounting blocks is secured to the stabiliser body by a bolt. The bolt is slotted into a recess in the tapered mounting block so that the head of the bolt is not exposed to the wall of the well bore. When the two tapered mounting blocks are tightened into position, the pressure exerted between the tapered mounting blocks and the tapered mounting part 3 of the stabiliser blade in the recess locks the entire assembly in place. The head of the bolt that slots into the tapered mounting block is greater than the hole in the top of the tapered mounting block, through which the bolt is tightened.

Although this configuration has shown to be working in a satisfactory manner in normal circumstances, it led to severe failure when the forces into play reach certain threshold values. In case of impact forces higher than certain threshold values some of the blades can be forced out of their recesses and the blocks that secure the blade to the body can suffer severe damages. This makes necessary to provide some improvements to the mounting of the blades to overcome the described problems and to ease replacement of worn out or broken parts.

SUMMARY OF THE INVENTION

It is the object of the present invention to provide a stabiliser tool for drilling strings that overcomes the aforementioned problems and has a higher resistance to impacts, a better hydrodynamic performance in operation, and has easier and cheaper maintenance costs. These aims are achieved by a drilling string stabiliser tool, according to claim 1, comprising a cylindrical body defining a longitudinal axis and having on its surface a plurality of longitudinal grooves each with a respective pin, extending radially from the bottom surface inside the grooves and being an integral part of the cylindrical body and a plurality of stabiliser blades having an elongated shape extending parallelly to said longitudinal axis and comprising a radially distal part and a radially proximal part, wherein the longitudinal extension of said radially distal part is shorter than the longitudinal extension of said radially proximal part, wherein said radially proximal part comprises a rectangular first part and a tapered second part located axially opposite to said first part and provided with shank holes for the passage of fixing bolts on said first and second parts, said radially proximal part being of complementary shape to one of longitudinal grooves and having a longitudinal slot to engage one of said pins having complementary shape.

Thanks to these features, the stabiliser tool has improved properties, in particular with respect to friction, hydrodynamic properties, use, maintenance and/or costs. The enhanced shape and interchangeable blades significantly improve oriented drilling and stabilization, reducing instances of torque, drag and wellbore damage. The tool is ideal for working in offshore locations as stabiliser blades are replaceable, they can be easily and quickly replaced on the rig site. This feature enables the stabiliser tool to be repaired at the rig site, enabling worn and damaged stabiliser blades to be quickly replaced, eliminating the necessity to transport worn or damaged stabiliser tools to a specialized workshop for repair. Stabiliser blades of different sizes, e.g. of different thickness T, width or length, can be fitted to the cylindrical body, eliminating the necessity to have additional under-gauge stabiliser tools on the rig site. The ability to replace damaged or worn stabiliser blades on location, and dress the cylindrical body with blades of different sizes will greatly reduce the inventory of stabiliser tools required on location. The cost saving on daily rental charges, transportation costs, and the reduction in storage space adds to the technical advantage of the replaceable blade stabiliser concept.

By the introduction of the pin it is possible to reach a better evenly distribution of the loads. Furthermore the blades can be fully embedded into the stabiliser body resulting in better hydrodynamic performances. Other advantages are a greater surface contact area and a wider foot print that results in an improved stability.

Advantageously the blades are placed further apart on the surface of the stabiliser body with a consequent increase of the flow area between the blades. Advantageously the realization of hydrodynamic flutes will improve self-cleaning and jetting effects, accelerating cuttings transportation over the body upset area. The self-cleaning action minimises mud build up and balling up, increasing homogeneous drilling fluid flow. The new design reduces the possibility of balling up or pack off, also mitigating causes of lost circulation or well control risk.

Advantageously a rectangular periphery area at the front portion of the lower mounting part and a triangular one at the back (or rear) portion will accommodate respectively three holes and one hole for the mounting bolts, that together with the central pin greatly improve the stability of the system. The stabiliser blades are thus detachably connected to the cylindrical body.

Advantageously the blades have a dome shaped contact area. In this description we refer conventionally to the triangle-shaped part of the stabiliser blades as the back (or rear) part of the stabiliser blade only for ease of description, without giving any limiting meaning to these adjectives as to the manner of using the stabiliser tool.

The cylindrical body upset of the invention has the advantage of minimising the risk of potential hang up and borehole damage when tripping in and out of a hole. To enhance this advantage in the stabiliser blades there is provided a shallow lead and a trailing upset angle, of preferably 20°. Advantageously the stabiliser blades are monolithic. The stabiliser tool of the invention can withstand more lateral/axial loads, and more side loads than the solutions of the state of the art and, further, the stabiliser tool reduces the possibility of balling up or pack off, also mitigating causes of lost circulation or well control risk. Advantageously the outer diameter of the circular envelope defined by the radially distal surface of the stabiliser blades of the stabiliser tool can be adjusted or modified to any gauge desired. This is made by means of inserting shims and/or in combination with different radial heights of the stabiliser blades.

As blades are replaceable, they can be easily and quickly replaced on the rig site. This feature enables the stabiliser tool to be redressed or repaired at the rig site, enabling worn out and damaged stabiliser blades to be quickly replaced and eliminating the necessity to transport worn or damaged stabilisers to a specialized workshop for repair. Blades of different sizes can be fitted to the cylindrical body, eliminating the necessity to have additional under-gauge stabiliser tools on the rig site. The capacity to replace damaged or worn stabiliser blades on location, and to mount on the stabiliser tool stabiliser blades of different sizes greatly reduces the inventory of stabiliser tools required on the drilling location. The capital savings on daily rental charges, transportation costs, and the reduction in storage space, adds to the technical advantage of the invention.

BRIEF DESCRIPTION OF THE DRAWINGS

Further features and advantages of the invention will be more apparent in light of the detailed description of preferred, but not exclusive, embodiments, of a drilling string stabiliser illustrated by way of a non-limitative example, with the aid of the accompanying drawings, in which.

The same reference numbers in the drawings identify the same elements or components.

DETAILED DESCRIPTION OF PREFERRED EMBODIMENTS

Figure 1:
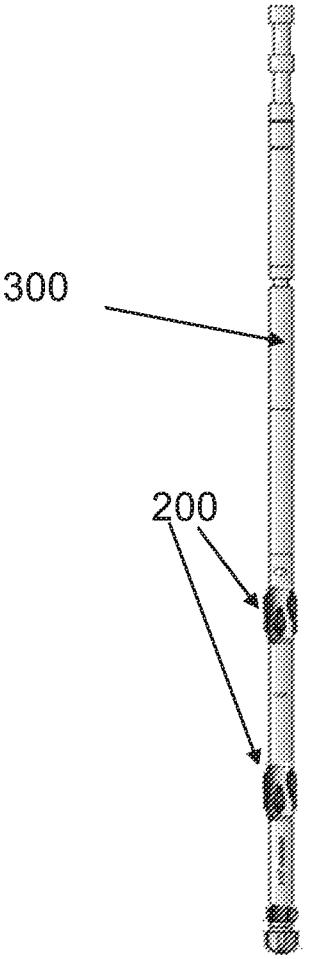
FIG. 1 is a schematic drawing of a drilling assembly (bottom hole assembly)
Figure 2:
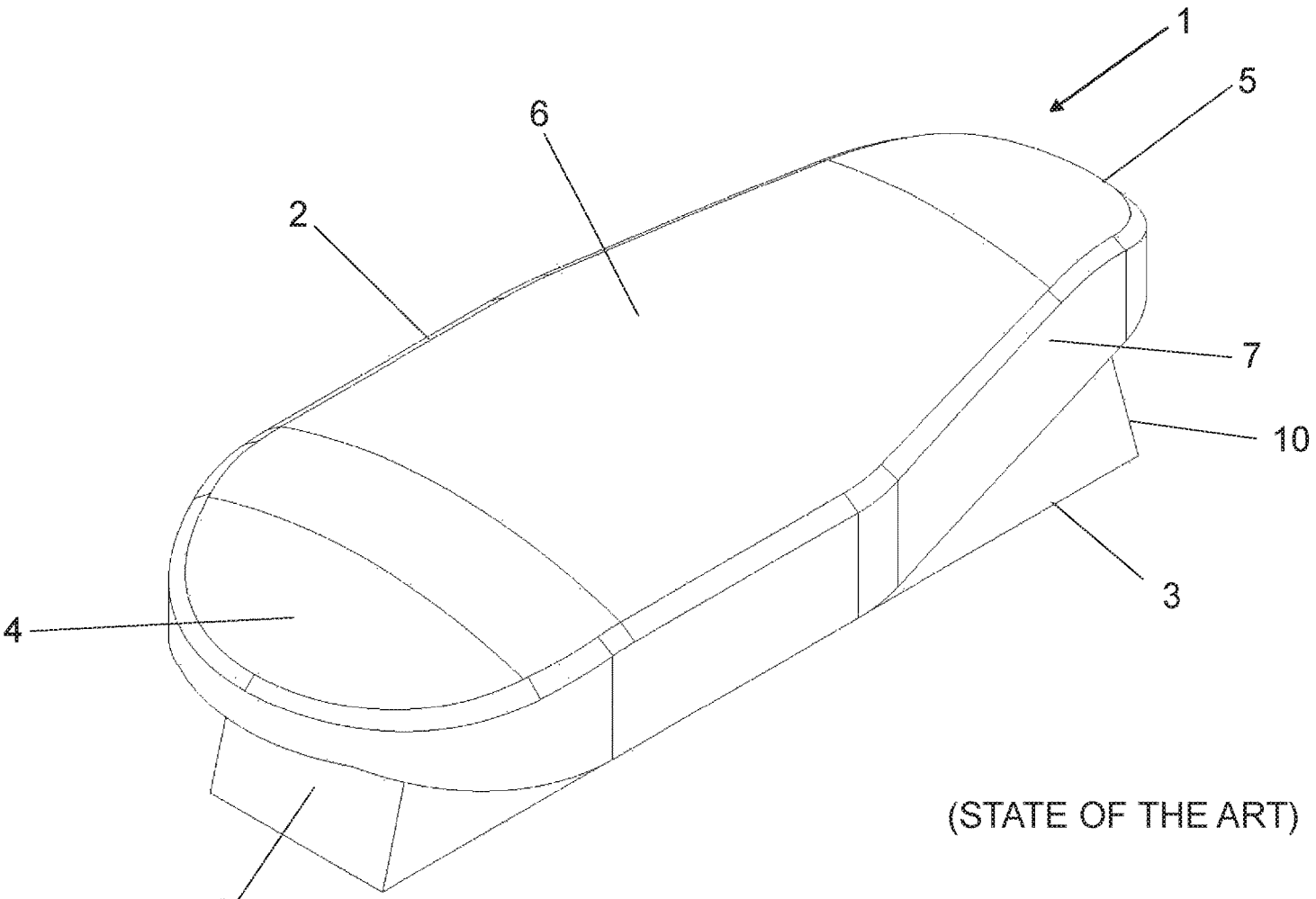
FIG. 2 is a perspective view of a stabiliser blade according to the state of the art.
Figure 3:
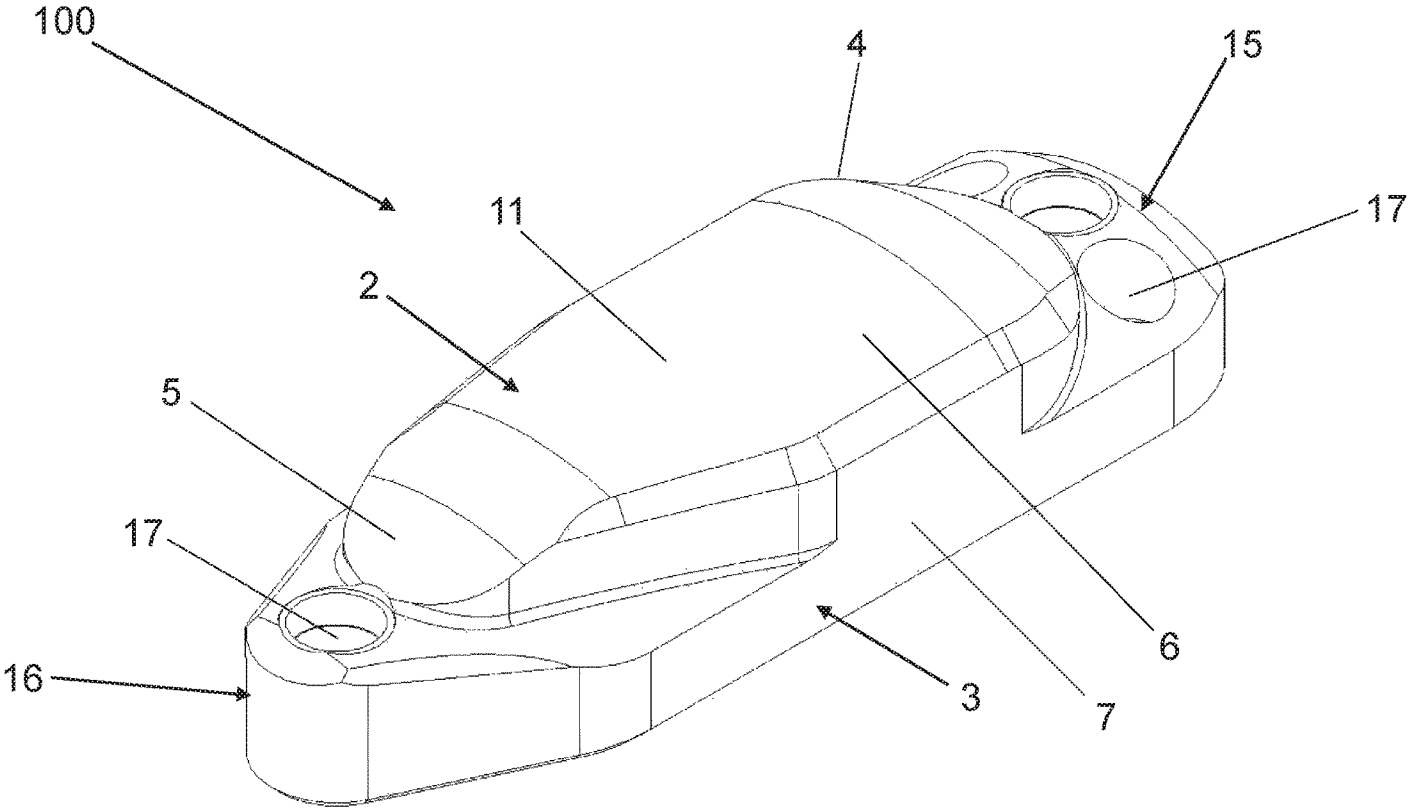
FIG. 3 is a perspective view of a component of a stabiliser tool according to the present invention.

A stabiliser tool 200 according to the invention is shown in FIG. 1 mounted in two positions along a drill string 300. With particular reference to the FIGS. 3 to 9 the stabiliser tool 200 of the invention comprises six stabiliser blades 100 made from mild steel. The stabiliser blades are preferably all of identical shape and we describe only one stabiliser blade.

The stabiliser blade 100 is monolithic and has an elongated shape defining a longitudinal axis. It comprises an upper stabilizing part 2, placed radially distally from the longitudinal axis X of the stabilizer tool 200 when mounted, and a lower mounting part 3, placed radially proximally from the longitudinal axis of the stabilizer tool when mounted. The upper stabilizing part 2 has the shape of a wing and comprises a front section 4, a back section 5 and a central section 11. The central section 11 has a width perpendicularly to the longitudinal axis of magnitude equal to the width of the lower mounting part 3 and a vertical wall 7 as continuation of the vertical wall of the lower mounting part 3. The front section 4 tapers from the central section towards a substantially semicircular front end, while the back section 5 has substantially the shape of a semicircle. The stabiliser blade 100 has an upper surface 6 defining the contact area. Said surface has a shape approximately of a dome. The upper surface 6 of the stabiliser blade 100 slopes downwards near and towards the end of the front section 4 and also near and towards the end of the back section 5. Preferably, all edges between the side vertical walls 7 and the upper surface 6 are rounded and similarly a rounding of the edges of all other walls having a border with the upper surface 6 is also performed.

The shape of the stabiliser blades 100 in conjunction with the hydrodynamic flutes and their positioning are such that they can efficiently displace the drilling fluids and drilling cuttings around the blades, and greatly reduce balling-up and packing off of the stabiliser with drilled cuttings. The tapered shapes of the blade reduce friction, and enhance the stabiliser tool performance while sliding in the oriented mode. The function of the cross sectional taper of the stabiliser blade is to reduce rotary torque and minimize undercutting when drilling in the rotary mode.

Figure 4:
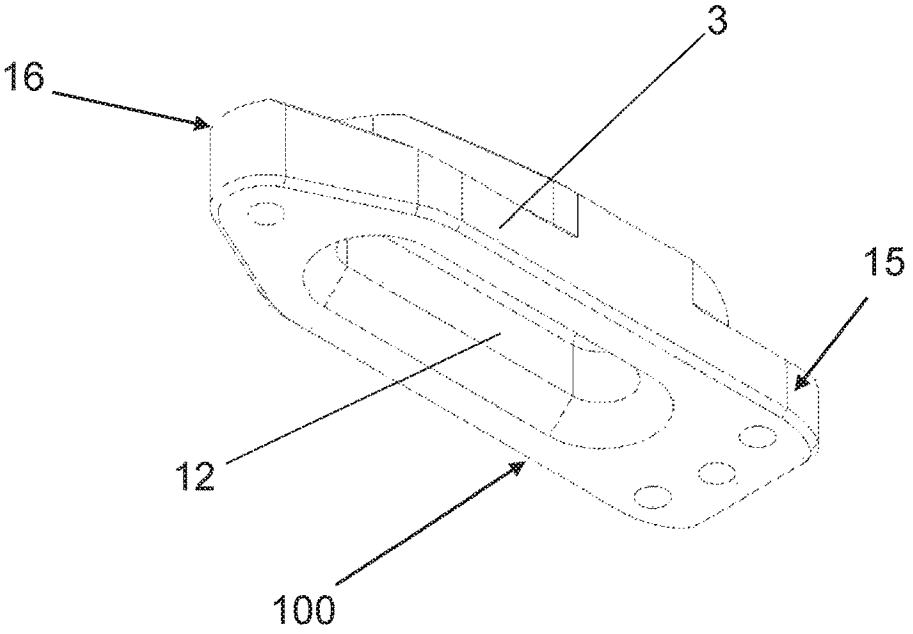
FIG. 4 is a perspective view of the component of FIG. 3 from another direction.
Figure 9:
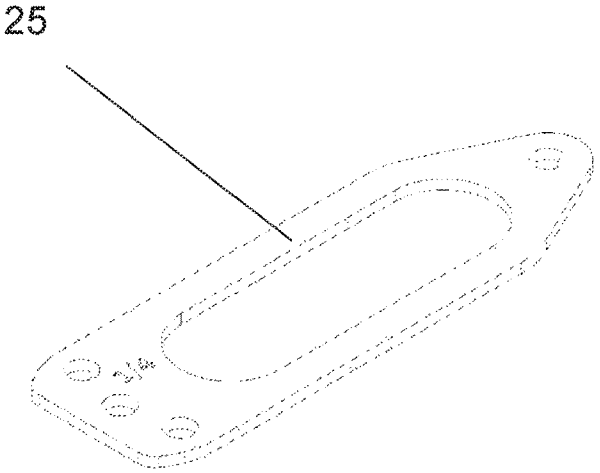
FIG. 9 is a perspective view of another component of the stabiliser tool according to the present invention.

FIG. 4 shows the stabiliser blade 100 seen in perspective from the bottom, i.e. from the side that is mounted in the position proximal to the axis X of the cylindrical body 20 when considering a radial reference system. The lower mounting part 3 has a recessed longitudinal slot 12 to engage a corresponding pin 13 protruding from the bottom surface of a recessed pocket or also simply called groove 14, generally formed by a milling operation, into the surface of the cylindrical body 20, see FIG. 6. The groove 14 has a rectangular lead periphery and a triangular rear periphery, and a centre pin structure having shape complementary to the corresponding parts of the lower mounting part 3 in order to accommodate it. The stabiliser blade 100 is secured in the groove 14 by bolts 18. A rectangular peripheral area 15 at the front part of the lower mounting part 3 and a triangular one 16 at the back part of the lower mounting part 3 will accommodate respectively three holes 17 and one hole 17 for the mounting bolts. Three holes are formed also in the front (or lead) rectangular periphery of the groove 14 and one in the rear (or back) triangular periphery. In this manner the stabiliser blade is fully imbedded in the cylindrical body 20 and the loads acting on it are evenly distributed to the structure of the cylindrical body 20 by means of the contact existing with the central pin 13 and with the walls of the groove 14.

Figure 5:
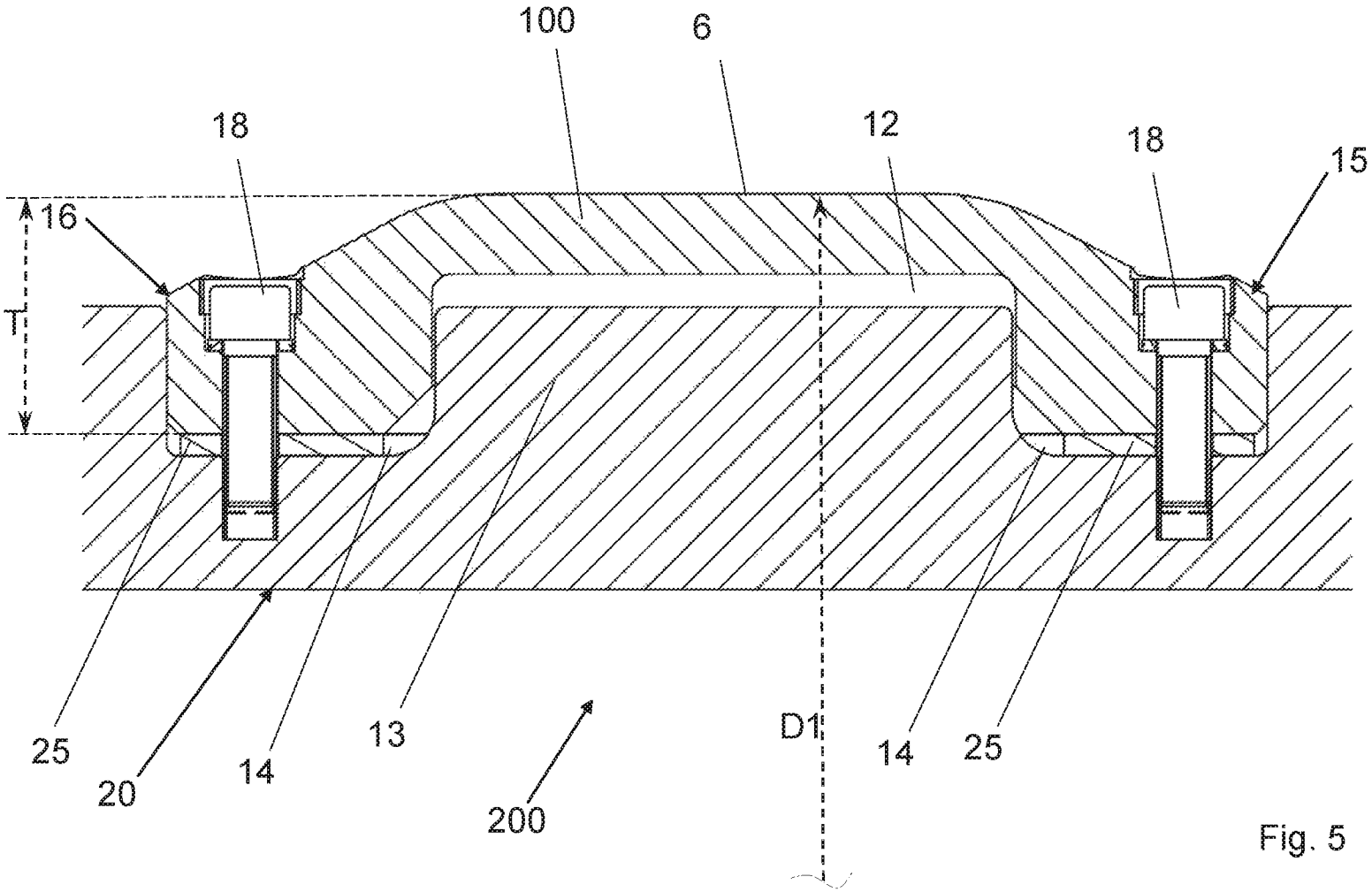
FIG. 5 is a cross-section along a longitudinal plane of a component of stabiliser tool of the invention.
Figure 6:
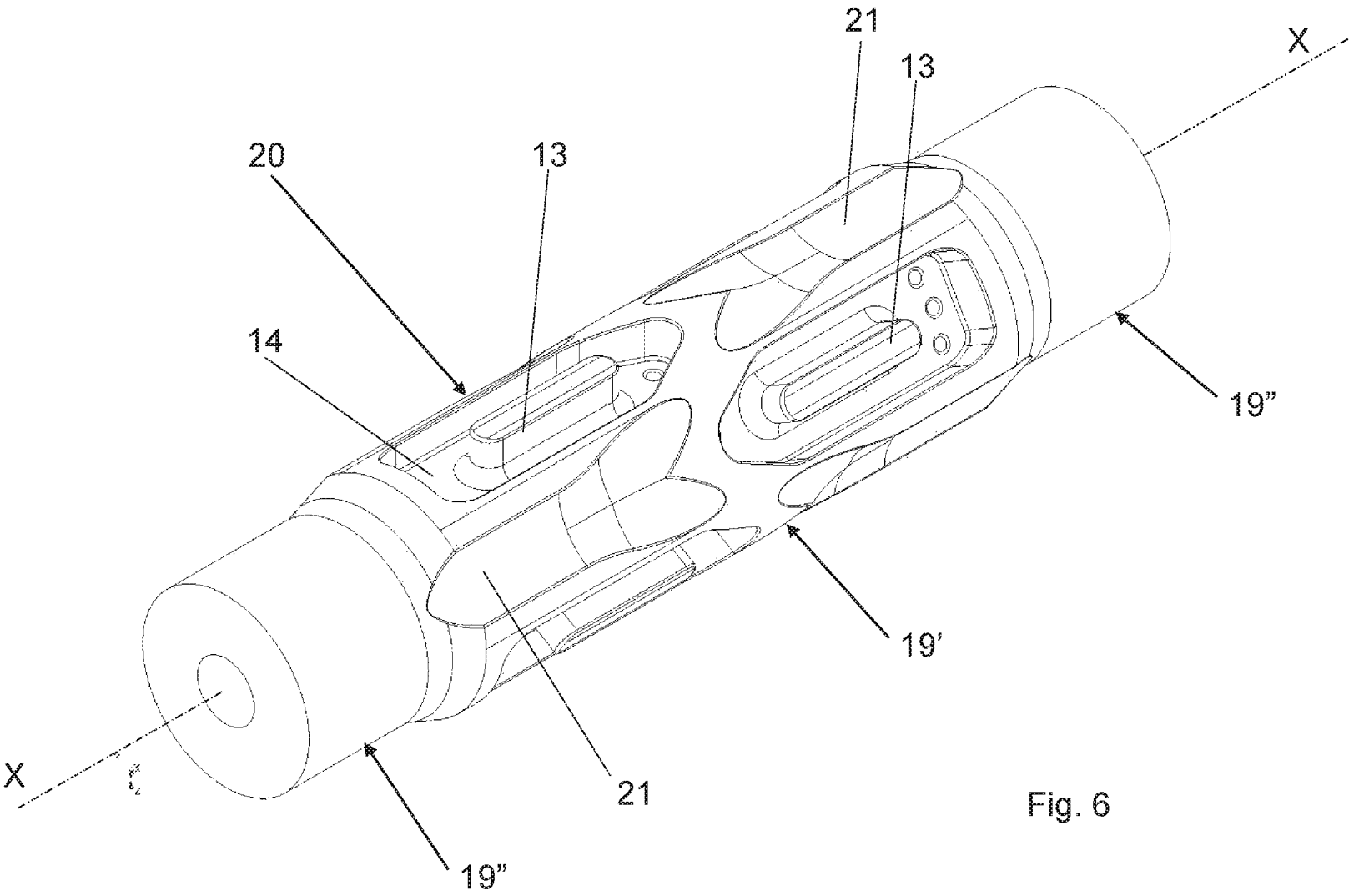
FIG. 6 is a perspective view of the stabiliser tool before the mounting of the stabiliser blades.

FIG. 5 shows in a partial longitudinal cross section of the stabiliser tool with the stabiliser blade 100 inserted in the groove 14 at the surface of the cylindrical body 20 with the pin 13 engaging the recessed slot 12 of the stabiliser blade 100. Also shown in this figure are the fixing bolts 18, four for each stabiliser blade, but more or less than four bolts are also possible, depending of the dimensions of the stabiliser tool and of the forces acting on the stabiliser blades.

The outer diameter D1 of the circular envelope defined by the radially distal surface of the stabiliser blades 100 of the stabiliser tool 200 can be adjusted or modified to any gauge desired, generally by 1 inch, but not exclusively and also other dimensions can be achieved. This increase in the diameter D1 of the stabiliser tool is made in increments of e.g. ⅛ inch by means of shims 25 or thin metal leveling plates. The use of the shims 25 can be combined with sets of stabiliser blades of different thicknesses T. So that any diametric dimension D1 can be made, depending on the needs of the users.

Figure 8:
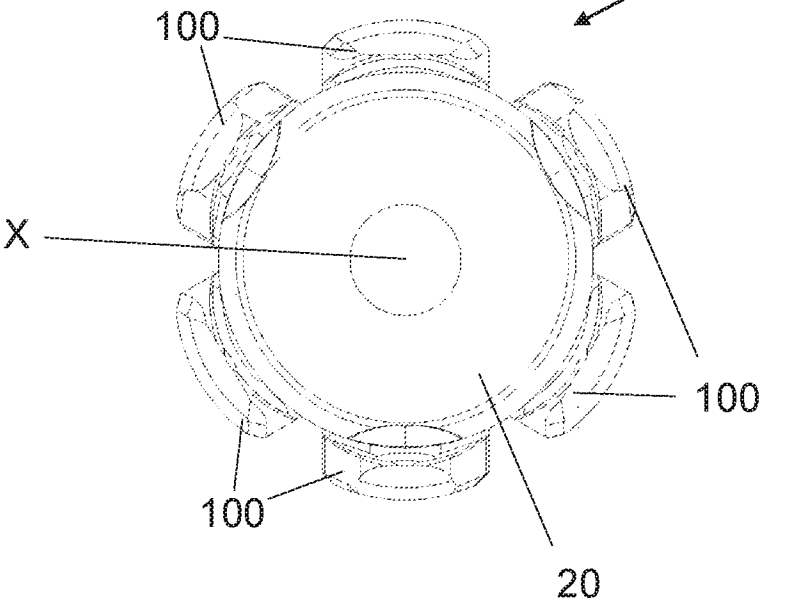
FIG. 8 is a partial cross-section on a plane transversal to the axis of the stabiliser tool of FIG. 7.
Figure 7:
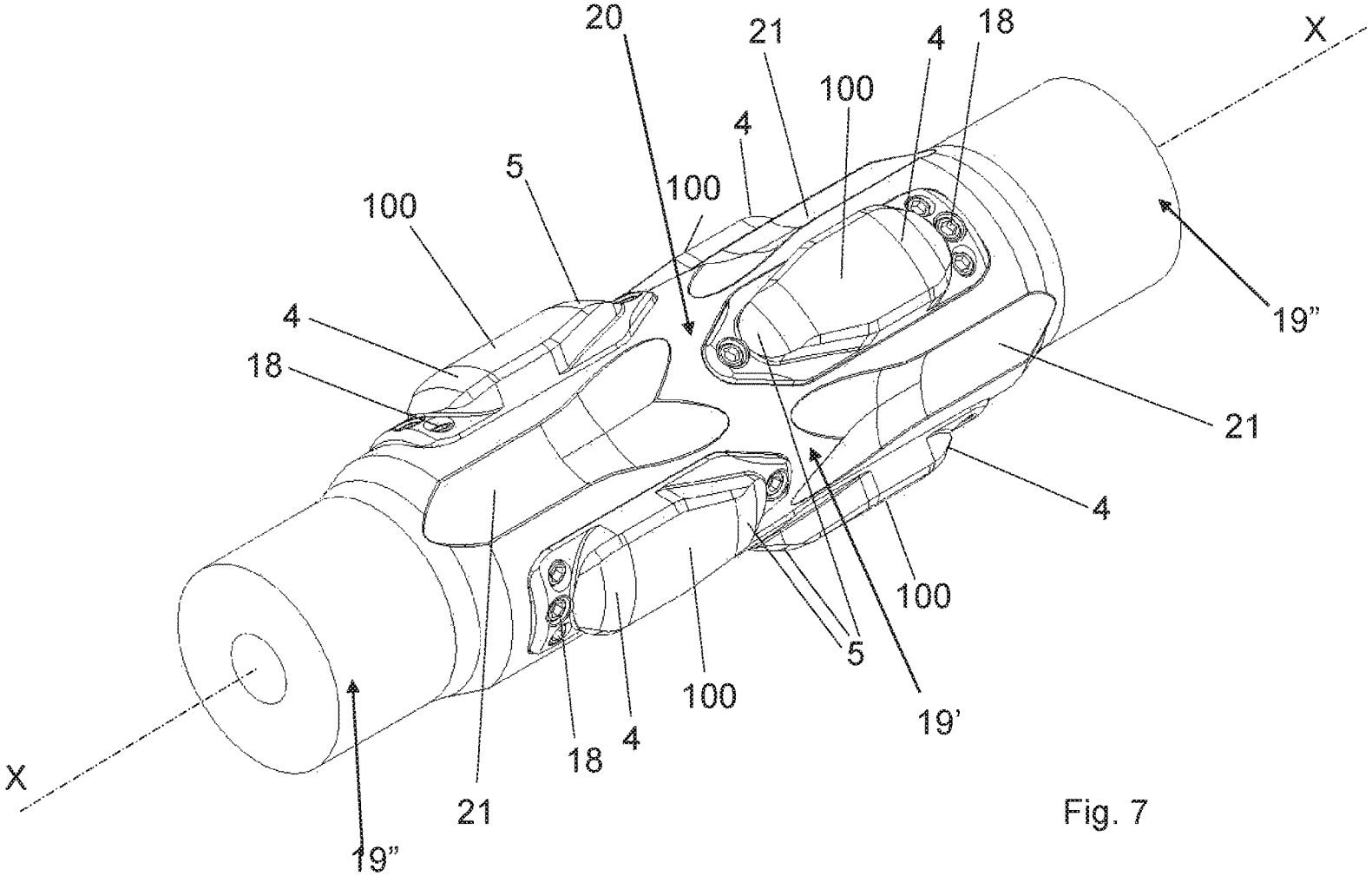
FIG. 7 is a perspective view of a stabiliser tool with the stabiliser blades mounted.

FIG. 7 shows a perspective view of the stabiliser tool 200 with six mounted stabiliser blades. A front view from one end of the stabiliser tool 200 is shown in FIG. 8. The cylindrical body 20 is divided in a central portion 19' having a diameter slightly larger than the end portions 19" of the cylindrical body, which can be connected to a drilling string having the same diameter. Up to ten stabiliser blades 100 can be mounted with their axes aligned and parallel on the cylindrical surface of the central portion 19' of the cylindrical body 20, so that the stabiliser blades 100 are also axially aligned and parallel with the axis X of the cylindrical body 20.

A first group of three stabiliser blades 100, or alternatively more than three, depending on the embodiment, is arranged and equally distributed along a first ideal circle on the surface of the cylindrical body 20 facing in the down flow direction. A second group of three stabiliser blades 100 facing in the up flow direction, or alternatively more than three, depending on the embodiment, is arranged and equally distributed along a second ideal circle, spaced apart from the first ideal circle. The front ends 4 on both ideal circles extend in opposite directions, away from both ideal circles, such that the front area of the forward moving stabiliser tool 200 is provided with the wider front ends 4 of the stabiliser blades 100, irrespective of the direction in which the drilling string 300 is being moved. The two groups of stabiliser blades 100 are arranged in such a way that their back ends 5 are arranged between each other, where the back ends 5 reach, in axial direction, approximately towards the central part of the back ends 5 of the adjacent stabiliser blades 100. Thanks to this lay out of the stabiliser blades oblique channels are formed between the back end 5 of each neighbouring pair of stabiliser blades 100, for allowing flowing of liquids during operations in the well.

In a particularly advantageous embodiment, between each stabiliser blade 100 there are hydrodynamic flutes 21 milled into the cylindrical body 20 designed to create a self-cleaning and jetting effect, accelerating cuttings transportation over the cylindrical body upset area. The self-cleaning action, i.e. the jet effect, has shown minimised mud build up, homogeneous drilling fluid flow, and minimised balling up.

These hydrodynamic flutes 21 are located on the surface of the cylindrical body 200 along two coaxial ideal circles axially spaced apart from one another and are aligned with the axis X of the cylindrical body 20 and parallel to one another. They are shaped advantageously as a rocket-shaped channel with a nose or cone at the front tail, and two diverging paths at the tail end, to improve the hydrodynamic effect. The number of hydrodynamic flutes 21 located on each circle can be three or more depending also from the diameter of the stabilizer tool and from the number of stabilizer blades that are mounted on it.

Whereas the invention is described by way of a preferred embodiments, the man skilled in the art will appreciate that many modifications can be made within the scope of the invention as defined by the claims.

The invention claimed is:

1. A stabiliser tool for a drilling string comprising: a cylindrical body defining a longitudinal axis X and having on its surface a plurality of longitudinal grooves each with a respective pin, each respective pin extending radially from a bottom surface inside a respective longitudinal groove of the plurality of longitudinal grooves, being elongated in a direction parallel to the longitudinal axis, and being an integral part formed from the same material as the cylindrical body, and a plurality of stabiliser blades having an elongated shape extending parallel to said longitudinal axis X and comprising a radially distal part and a radially proximal part, wherein the longitudinal extension of said radially distal part is shorter than the longitudinal extension of said radially proximal part, wherein said radially proximal part comprises a rectangular part and a tapered part located axially opposite to said rectangular part and provided with shank holes for a passage of fixing bolts on said rectangular part and tapered part, said radially proximal part being of complementary shape to one of the plurality of longitudinal grooves and having a longitudinal slot to engage one of said pins having complementary shape.

2. The stabiliser tool, according to claim 1, wherein a plurality of hydrodynamic flutes are provided on the surface of the cylindrical body and each hydrodynamic flute is placed between two adjacent longitudinal grooves of said plurality of longitudinal grooves.

3. The stabiliser tool according to claim 2, wherein the plurality of hydrodynamic flutes are axially aligned with the longitudinal axis X.

4. The stabiliser tool according to claim 3, wherein the centers of the plurality of hydrodynamic flutes are located along at least two coaxial spaced apart ideal circles on the surface of the cylindrical body.

5. The stabiliser tool according to claim 4, wherein three or more hydrodynamic flutes are located on each ideal circle.

6. The stabiliser tool according to claim 2, wherein the plurality of hydrodynamic flutes are milled channels interrupting a circular cross section of the cylindrical body.

7. The stabiliser tool, according to claim 1, wherein the stabiliser blades are monolithic.

8. The stabiliser tool according to claim 1, wherein the stabiliser blades are detachably connected by means of bolts to the cylindrical body.

9. The stabiliser tool according to claim 1, wherein a dimension of an outer diameter D1 of a cylindrical envelope defined by a rotation of the stabiliser tool around its longitudinal axis can be varied by means of shims or leveling thin plates inserted in each longitudinal groove of said plurality of longitudinal grooves and its respective stabiliser blade.

10. The stabiliser tool, according to claim 1, wherein the average width of the tapered part of said plurality of stabiliser blades is substantially smaller than an average width of the rectangular part of said plurality of stabiliser blades.

11. The stabiliser tool according to claim 1, wherein the stabiliser blades are axially aligned with said longitudinal axis X.

12. The stabiliser tool according to claim 1, wherein the stabiliser blades are located along at least two coaxial spaced apart ideal circles on the surface of the cylindrical body.

13. The stabiliser tool according to claim 12, wherein the plurality of stabiliser blades include more than three stabiliser blades and along each ideal circle there are placed at least three stabiliser blades.

14. The stabilizer tool according to claim 1, wherein edges between an upper surface and side walls surrounding it are rounded.

15. The stabiliser tool, according to claim 1, wherein each longitudinal groove has a rectangular lead periphery at a front end of the pin and a triangular rear periphery at a rear end of the pin.

16. A stabiliser tool for a drilling string comprising:

a cylindrical body defining a longitudinal axis X and having on its surface a plurality of longitudinal grooves each with a respective pin, each respective pin extending radially from a bottom surface inside a respective longitudinal groove of the plurality of longitudinal grooves and being elongated in a direction parallel to the longitudinal axis, and being integral and formed from the same material as the cylindrical body;

a plurality of stabiliser blades having an elongated shape extending parallel to said longitudinal axis X and comprising a radially distal part and a radially proximal part, wherein the longitudinal extension of said radially distal part is shorter than the longitudinal extension of said radially proximal part, wherein said radially proximal part comprises a rectangular part and a tapered part located axially opposite to said rectangular part and provided with shank holes for a passage of fixing bolts on said rectangular part and tapered part, said radially proximal part being of complementary shape to one of the plurality of longitudinal grooves and having a longitudinal slot to engage one of said pins having complementary shape; and at least one shim positioned between the radially proximal part of at least one stabiliser blade of the plurality of stabiliser blades and the bottom surface inside the respective longitudinal groove, the shim including holes for passage of the fixing bolts and/or an opening complementary in shape to a respective pin and the pin extends through the shim.

17. A stabiliser tool for a drilling string comprising:

a cylindrical body defining a longitudinal axis X and having a plurality of longitudinal grooves each with a respective pin and a plurality of hydrodynamic flutes, each respective pin extending radially from a bottom surface inside a respective longitudinal groove of the plurality of longitudinal grooves and being elongated in a direction parallel to the longitudinal axis, and being integral and formed from the same material as the cylindrical body, each hydrodynamic flute being placed between two adjacent longitudinal grooves of said plurality of longitudinal grooves and being a milled channel interrupting a circular cross section of the cylindrical body, wherein each hydrodynamic flute is a rocket-shaped channel with a nose or cone at a front tail, and two diverging paths at a tail end; and a plurality of stabiliser blades having an elongated shape extending parallel to said longitudinal axis X and comprising a radially distal part and a radially proximal part, wherein the longitudinal extension of said radially distal part is shorter than the longitudinal extension of said radially proximal part, wherein said radially proximal part comprises a rectangular part and a tapered part located axially opposite to said rectangular part and provided with shank holes for a passage of fixing bolts on said rectangular part and tapered part, said radially proximal part being of complementary shape to one of the plurality of longitudinal grooves and having a longitudinal slot to engage one of said pins having complementary shape.

* * * * *